US010508542B2

(12) United States Patent
Yoon

(10) Patent No.: US 10,508,542 B2
(45) Date of Patent: Dec. 17, 2019

(54) EXCAVATION ASSEMBLY FOR USE IN EXCAVATOR

(71) Applicant: Young Dug Yoon, Yongin-si (KR)

(72) Inventor: Young Dug Yoon, Yongin-si (KR)

( * ) Notice: Subject to any disclaimer, the term of this patent is extended or adjusted under 35 U.S.C. 154(b) by 191 days.

(21) Appl. No.: 15/532,127

(22) PCT Filed: Dec. 17, 2015

(86) PCT No.: PCT/KR2015/013841
§ 371 (c)(1),
(2) Date: Jun. 1, 2017

(87) PCT Pub. No.: WO2016/099163
PCT Pub. Date: Jun. 23, 2016

(65) Prior Publication Data

US 2017/0268336 A1 Sep. 21, 2017

(30) Foreign Application Priority Data

Dec. 19, 2014 (KR) ..... 10-2014-0185037
Mar. 19, 2015 (KR) ..... 20-2015-0001728 U

(51) Int. Cl.
*E21D 9/10* (2006.01)
*E02F 3/78* (2006.01)
(Continued)

(52) U.S. Cl.
CPC ..... *E21D 9/1013* (2013.01); *E02F 3/30* (2013.01); *E02F 3/32* (2013.01); *E02F 3/3636* (2013.01);
(Continued)

(58) Field of Classification Search
CPC .... E21D 9/1013; E02F 3/3604; E02F 3/3609; E02F 3/3636; E02F 5/305–326
See application file for complete search history.

(56) References Cited

U.S. PATENT DOCUMENTS 3,174,562 A * 3/1965 Stow ..... E21B 7/005 173/152
4,070,772 A * 1/1978 Motomura ..... E02F 3/286 173/46
(Continued)

FOREIGN PATENT DOCUMENTS

JP H04-129681 A 4/1992
JP H05-007783 U 2/1993
(Continued)

*Primary Examiner* — Janine M Kreck
(74) *Attorney, Agent, or Firm* — KORUS Patent, LLC; Seong Il Jeong

(57) ABSTRACT

There is provided an excavation assembly for use in an excavator, wherein the excavation assembly is removably coupled to an arm at a pair of spaced shaft-receiving portions defined therein, wherein the excavation assembly performs an excavation operation into a ground or a rock, wherein the excavation assembly comprises: a body removably coupled at one end thereof to the pair of spaced shaft-receiving portions; a driving mechanism configured to generate at least one of a linear driving force, a rotational driving force, and a striking force; an excavation tool coupled to the driving mechanism and configured to be driven by at least one of the linear driving force, the rotational driving force, and the striking force transmitted from the driving mechanism, thereby to perform the excavating operation, wherein a direction of the excavation operation by the excavation tool varies depending on coupling positions between the pair of spaced shaft-receiving portions and the body.

10 Claims, 15 Drawing Sheets

(51) Int. Cl.

| | |
|---|---|
| ***E02F 3/32*** | (2006.01) |
| ***E02F 9/22*** | (2006.01) |
| ***E02F 3/96*** | (2006.01) |
| ***E02F 5/30*** | (2006.01) |
| ***E02F 3/30*** | (2006.01) |
| ***E02F 3/36*** | (2006.01) |

(52) U.S. Cl.
CPC ..... *E02F 3/78* (2013.01); *E02F 3/966* (2013.01); *E02F 5/305* (2013.01); *E02F 9/22* (2013.01); *E02F 9/2271* (2013.01)

(56) References Cited

U.S. PATENT DOCUMENTS 4,199,033 A * 4/1980 Van Gundy, Jr. ..... E02F 3/3677 173/192
4,719,975 A * 1/1988 LaBounty ..... B23D 17/06 173/46
4,877,091 A * 10/1989 Howell, Jr. ..... E21B 7/028 173/89
6,047,475 A * 4/2000 Tyrrell ..... E02F 3/965 241/101.73
7,832,130 B2 * 11/2010 Sederberg ..... E02F 3/3604 37/403
2013/0051964 A1 * 2/2013 Bernier ..... E02F 3/32 414/722

FOREIGN PATENT DOCUMENTS

KR 20-1996-0002678 Y1 3/1996
KR 10-2009-0106955 A 10/2009
KR 10-2010-0024467 A 3/2010
KR 10-2014-0077475 A 6/2014

* cited by examiner

EXCAVATION ASSEMBLY FOR USE IN EXCAVATOR

TECHNICAL FIELD

The present disclosure relates to an excavation assembly for use in the excavator, and more particularly, to an excavation assembly for use in the excavator whereby, in an excavation work using the excavator, it is possible to increase the ease of moving to various work places and work efficiency thereof, and to smoothly perform the excavation work even in a narrow working space such as a tunnel.

RELATED ART

In order to install a structure in the ground, the ground is excavated or drilled, and the structure is buried in the excavated or perforated ground. In general, the excavation work may include a boring work for crushing and boring an underground layer and rock, a piling work into the ground, a tunneling work, a work of mechanically cutting or crushing the ground, rock, and tunnel section at the construction site, etc.

Regarding the excavation work, conventional blasting methods using explosives cause generation of noise and vibration, stability problems of workers, and the like. Thus, they are being replaced by excavation methods using tunnel excavators.

However, the conventional tunnel excavator is complicated in structure, is expensive, and has a large size. Therefore, there has been a problem in that the work efficiency is lowered because of the limitations on the installation and the operation of the excavator in a narrow work space such as a tunnel. In addition, when excavation works are performed using the tunnel excavator, vibration and noise generation are severe, and, hence, damage to the surrounding area as well as the work site may occur.

For example, a hydraulic drilling apparatus is configured to perform a drilling operation by rotation of a drill bit in a state where the drill bit rotated by hydraulic pressure or the like is placed on a rock or soil. In the conventional hydraulic drilling apparatus, the drilling operation is performed only by the rotational force of the drill bit. Therefore, when the strength of the rock and the sand is high, the drilling operation is difficult.

In addition, a rock crushing apparatus is configured to crush a rock by a crushing body called a chisel via striking the rock using the striking force from the hydraulic cylinder. In the case of such a rock crushing apparatus, since the crushing force for crushing via the hydraulic cylinder is strong, the portion outside the excavation target range is also crushed and, hence, the ground is weakened. Thus, this approach may not be suitable for an inner face of a tunnel or a soft ground.

Therefore, there is a need for an excavation assembly for use in the excavator whereby, in an excavation work using the excavator, it is possible to increase the ease of moving to various work places and work efficiency thereof, and to smoothly perform the excavation work even in a narrow working space such as a tunnel.

SUMMARY

The present disclosure has been made in order to solve the above problems. The present disclosure is aimed to providing an excavation tool assembly for use in the excavator where the excavation tool assembly having a simpler and smaller structure is detachably coupled to the excavator with easy movement, whereby, in an excavation work using the excavator, it is possible to increase the ease of moving to various work places and work efficiency thereof, and to smoothly perform the excavation work even in a narrow working space such as a tunnel.

Another object of the present disclosure is to provide an excavator capable of smooth excavation work in a narrow working space such as a tunnel by disposing a first arm cylinder of an excavator below a bottom of the boom.

The technical objects of the present disclosure are not limited to those mentioned above, and another technical object which is not mentioned may be clearly understood by those skilled in the art from the following description.

In one aspect of the present disclosure, there is provided an excavation assembly for use in an excavator, wherein the excavator has an boom and an arm coupled to the arm, wherein the arm has a distal end having a pair of spaced shaft-receiving portions defined therein, wherein the excavation assembly is removably coupled to the arm at the pair of spaced shaft-receiving portions, wherein the excavation assembly is configured to perform an excavation operation into a ground or a rock, wherein the excavation assembly comprises: a body removably coupled at one end thereof to the pair of spaced shaft-receiving portions; a driving mechanism installed inside or on one side of the body and configured to generate at least one of a linear driving force, a rotational driving force, and a striking force; an excavation tool coupled to the driving mechanism and configured to be driven by at least one of the linear driving force, the rotational driving force, and the striking force transmitted from the driving mechanism, thereby to perform the excavating operation, wherein a direction of the excavation operation by the excavation tool varies depending on coupling positions between the pair of spaced shaft-receiving portions and the body.

In one embodiment, the body comprises: a housing having a receiving space defined therein; a pair of lateral and spaced brackets arranged on opposite sides of the housing on an outer face thereof respectively; and at least three shaft-type connectors coupled to and extended between the pair of lateral brackets at an upper portion of the housing, wherein the at least three shaft-type connectors are spaced apart from each other with an spacing corresponding to a spacing between the pair of spaced shaft-receiving portions, wherein two neighboring shaft-type connectors are selected among the at least three shaft-type connectors and are coupled to the pair of spaced shaft-receiving portions respectively such that a direction of the excavating operation of the excavation tool is determined.

In one embodiment, the driving mechanism comprises: a driver cylinder received within the receiving space and configured to generate a striking force, wherein the driver cylinder has an output shaft; a drive shaft having one end connected to the output shaft of the driver cylinder, wherein the drive shaft is configured to reciprocate using the striking force received from the driver cylinder; and a connector member having one end coupled to the other end of the drive shaft and the other end removably coupled to the excavation tool, wherein the connector member is configured to receive the striking force from the drive shaft to allow the excavation tool to reciprocally move.

In one embodiment, the housing comprises: a base body hollowed along a reciprocating direction of the drive shaft, wherein the pair of lateral brackets are arranged on opposite sides of the base body on an outer face thereof respectively; a hollow connection body coupled to the base body at a lower end thereof to define the receiving space together with the base body; and a body cover configured to close an open top portion of the base body with the driver cylinder being received in the receiving space.

In one embodiment, the driver cylinder is embodied as a hydraulic cylinder driven by oil supplied from the excavator.

In one embodiment, the excavation tool comprises: a striking tool body detachably coupled to one end of the driver cylinder through the other end of the housing, wherein the tool body is configured to reciprocate using the striking force; and a plurality of boring bits radially formed on a surface of the striking tool body abutting the ground or rock.

In one embodiment, the driving mechanism comprises: a drive motor received inside the receiving space, wherein the motor is configured to generate a rotational drive force; a drive shaft connected, at one end thereof, to a rotation shaft of the drive motor, wherein the drive shaft is configured to receive the rotational drive force from the drive motor; and a connector member having one end coupled to the other end of the drive shaft and the other end detachably coupled to the excavation tool, wherein the connector member is configured to receive the rotational driving force from the drive shaft to enable a rotation of the excavation tool.

In one embodiment, the housing comprises: a base body hollowed along an extension direction of the rotation shaft of the drive motor, wherein the pair of lateral brackets are arranged on opposite sides of the base body on an outer face thereof respectively; a hollow connection body coupled to the base body at a lower end thereof to define the receiving space together with the base body; and a body cover configured to close an open top portion of the base body with the drive motor being received in the receiving space.

In one embodiment, the drive motor is embodied as a hydraulic motor driven by oil supplied from the excavator.

In one embodiment, the excavation tool comprises: a rotatable body detachably coupled to one end of the drive motor through the other end of the housing, wherein the rotatable body is configured to rotate using the rotational drive force from the drive motor; and a plurality of rotation portions, each portion having one end rotatably coupled to a lower end of the rotatable body, each portion having a plurality of boring bits radially formed on a surface of the portion body abutting the ground or rock.

In another aspect of the present disclosure, there is provided an excavator comprising the above define assembly, the excavator comprising: a traveling system; an upper revolving structure on the traveling system; a boom having one end pivotally coupled to the upper revolving structure; a first arm having one end pivotally coupled to the other end of the boom; a second arm having one end pivotally coupled to the other end of the first arm and the other end having the pair of spaced shaft-receiving portions defined therein; at least one boom cylinder connecting the upper revolving structure and the boom, wherein the boom cylinder is configured to articulate the boom; at least one first arm cylinder connecting the first arm and the boom, wherein the first arm cylinder is configured to articulate the first arm; and at least one second arm cylinder connecting the first and second arms, wherein the second arm cylinder is configured to articulate the second arm, wherein the at least one first arm cylinder is disposed below a bottom of the boom.

The details of other embodiments are included in the detailed description and drawings.

Advantageous Effects

In accordance with the present disclosure, the excavation tool assembly having a simpler and smaller structure is detachably coupled to the excavator with easy movement. Thus, in an excavation work using the excavator, it is possible to increase the ease of moving to various work places and work efficiency thereof, and to smoothly perform the excavation work even in a narrow working space such as a tunnel.

In accordance with the present disclosure, a direction of the excavation operation by the excavation tool varies depending on coupling positions between the pair of spaced shaft-receiving portions and the body. That is, two neighboring shaft-type connectors are selected among the at least three shaft-type connectors and are coupled to the pair of spaced shaft-receiving portions respectively such that a direction of the excavating operation of the excavation tool is determined. Thus, the excavation tool may be easily oriented toward the desired working direction without being restricted in orientation due to the location of the excavator, a working radius of the arm provided in the excavator, etc.

In addition, according to the excavation assembly for use in the excavator according to the embodiments of the present disclosure, the first arm cylinder of the excavator is disposed below the bottom of the boom, so that a smooth excavation work can be performed even in a narrow work space such as a tunnel.

According to the excavation assembly for use in the excavator according to the embodiments of the present disclosure, the excavation assembly may be detachably attached to the second arm. Thus, various excavation assemblies may be easily replaced. Therefore, the efficiency of operation can be increased.

In addition, according to the excavation assembly for use in the excavator according to the embodiments of the present disclosure, an excavator having a simple structure, a small size, and a low cost is used at the time of tunnel construction. Thu, it is possible to remove the cost of separately preparing an excavator for tunnel construction. Further, it is possible to minimize the vibration and noise generated when the excavation work is performed by using the tunnel excavator.

The effects of the present disclosure are not limited to the effects mentioned above, and other effects not mentioned may be clearly understood by those skilled in the art from the description of the claims.

DETAILED DESCRIPTION

Figure 1:
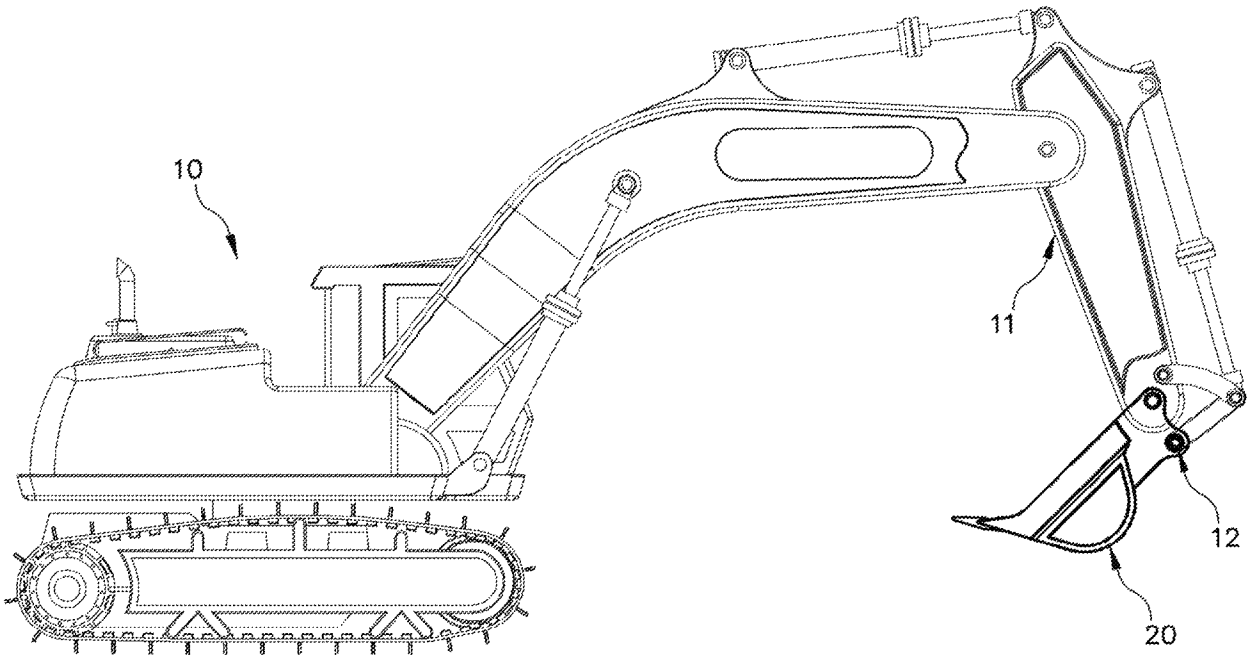
FIG. 1 is a view schematically showing a structure of a general excavator.

Hereinafter, preferred embodiments of the present disclosure will be described in detail with reference to the accompanying drawings, so that those skilled in the art can easily carry out the present disclosure.

In describing the embodiments, descriptions of techniques which are well known in the art to which the present disclosure belongs and which are not directly related to the present disclosure are not described. This is to omit the unnecessary explanation so that the gist of the present disclosure will not be overlooked.

For the same reason, some of the elements in the accompanying drawings are exaggerated, omitted or schematically shown. In addition, the size of each component in the drawing does not reflect an actual size. In the drawings, the same or corresponding components are denoted by the same reference numerals.

Hereinafter, embodiments of the present disclosure will be described with reference to the drawings for explaining an excavation assembly 1 for use in the excavator.

Figure 2:
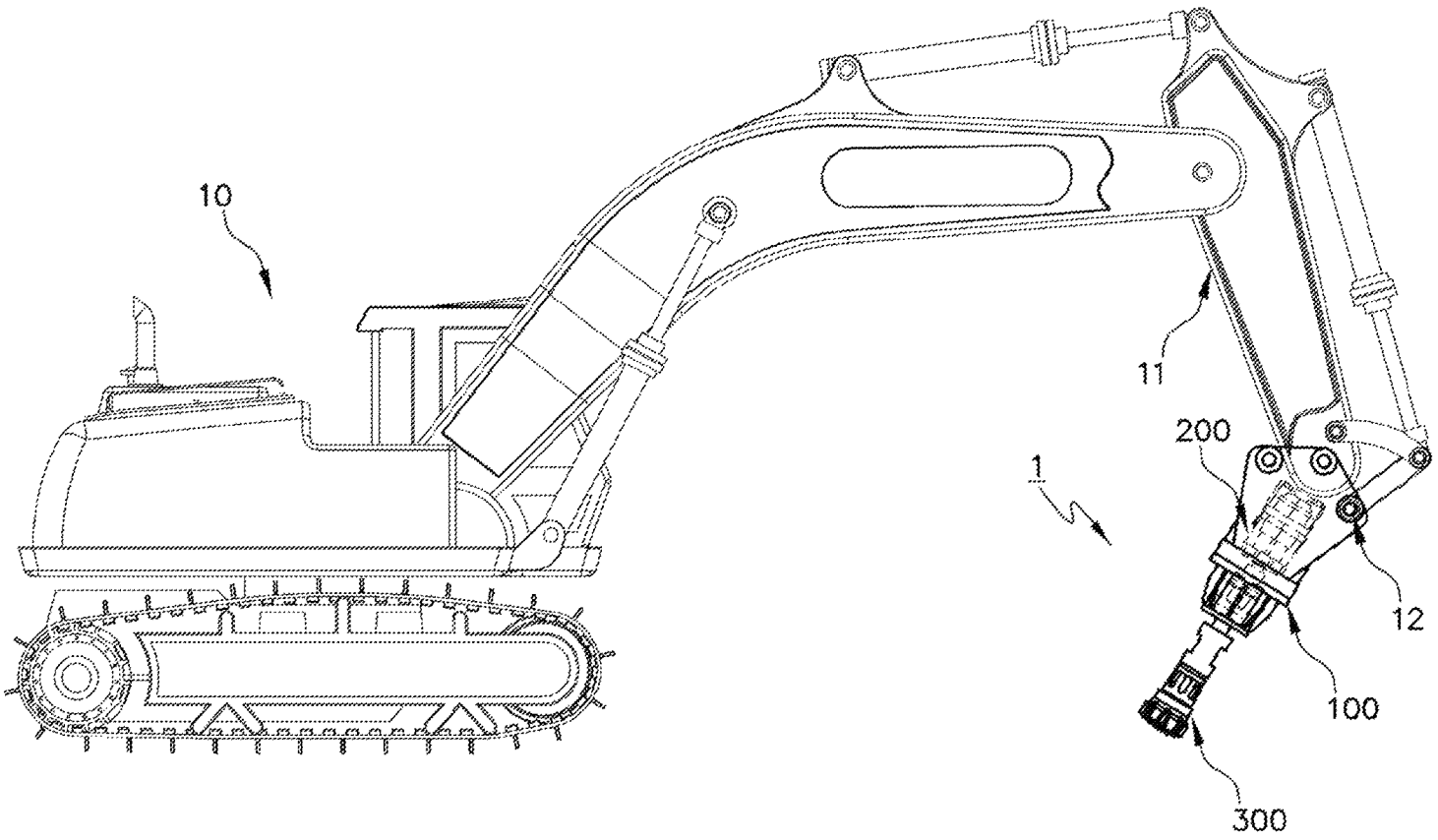
FIG. 2 is a view schematically showing a state in which an excavation assembly for use in the excavator according to an embodiment of the present disclosure is installed in the excavator.

FIG. 1 is a view schematically showing a structure of a general excavator. FIG. 2 is a view schematically showing a state in which an excavation assembly for use in the excavator according to an embodiment of the present disclosure is installed in the excavator.

A general excavator 10 is a construction machine that performs operations such as digging the earth, transporting the earth and sand, dismantling the building, and arranging the ground or rock in civil engineering, building, and construction sites. The excavator may include a traveling system for moving the excavator, an upper revolving structure mounted on the traveling system and rotating 360 degrees, and an arm 11 mounted to the upper revolving structure and performing a loading operation, etc. via link drive.

The arm 11 may be coupled to a bucket for general excavation and soil loading, a breaker for breaking hard ground or rock, and a crusher used for dismantling the building. FIG. 1 shows an example in which a bucket 20 is coupled to the arm 11 of the excavator 10 for general excavation and soil transfer. As shown in FIG. 1, the bucket 20 may be connected to a pair of spaced shaft-receiving portions 12 provided at a distal end of the arm 11 mounted to the upper revolving structure of the excavator 10. The bucket 20 may be detachably attached to the pair of spaced shaft-receiving portions 12, as needed, due to job changes.

As shown in FIG. 2, according to embodiments of the present disclosure, the excavation assembly 1 for use in the excavator may be installed in the excavator 10 having the arm 11 having the pair of spaced shaft-receiving portions 12 to allow the bucket 20 to be detachably attached thereto. Thereby, the excavator may perform excavation work on the ground or rock. As described above, according to the embodiments of the present disclosure, the excavation assembly 1 may allow an excavation tool having a simpler and smaller structure to be removably attachable to the excavator 10 with excellent mobility. For excavation operations, it is possible to increase the ease of movement to various work places and accordingly the work efficiency.

Hereinafter, the excavation assembly for use in the excavator according to the first embodiment of the present disclosure will be described with reference to FIGS. 3 to 9.

Figure 3:
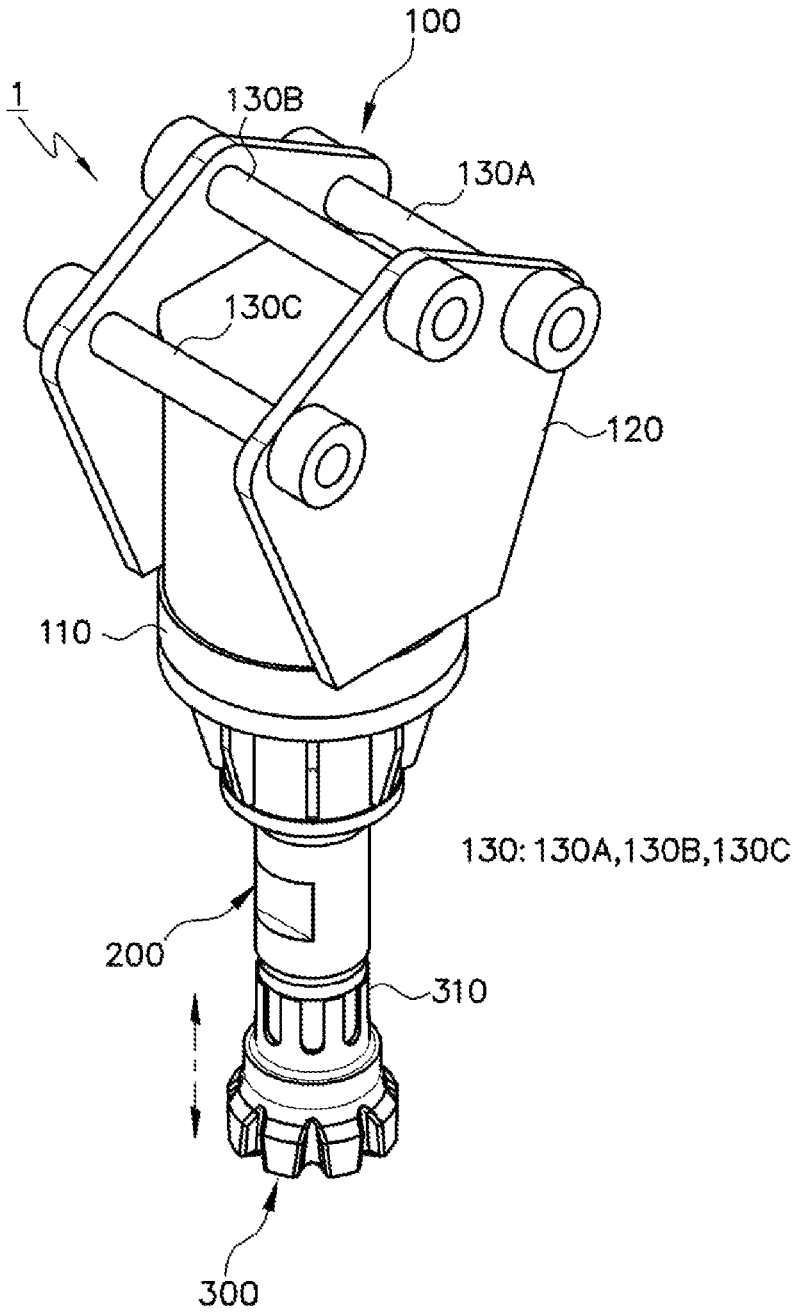
FIG. 3 is a perspective view illustrating the structure of the excavation assembly for use in the excavator according to the first embodiment of the present disclosure.
Figure 4:
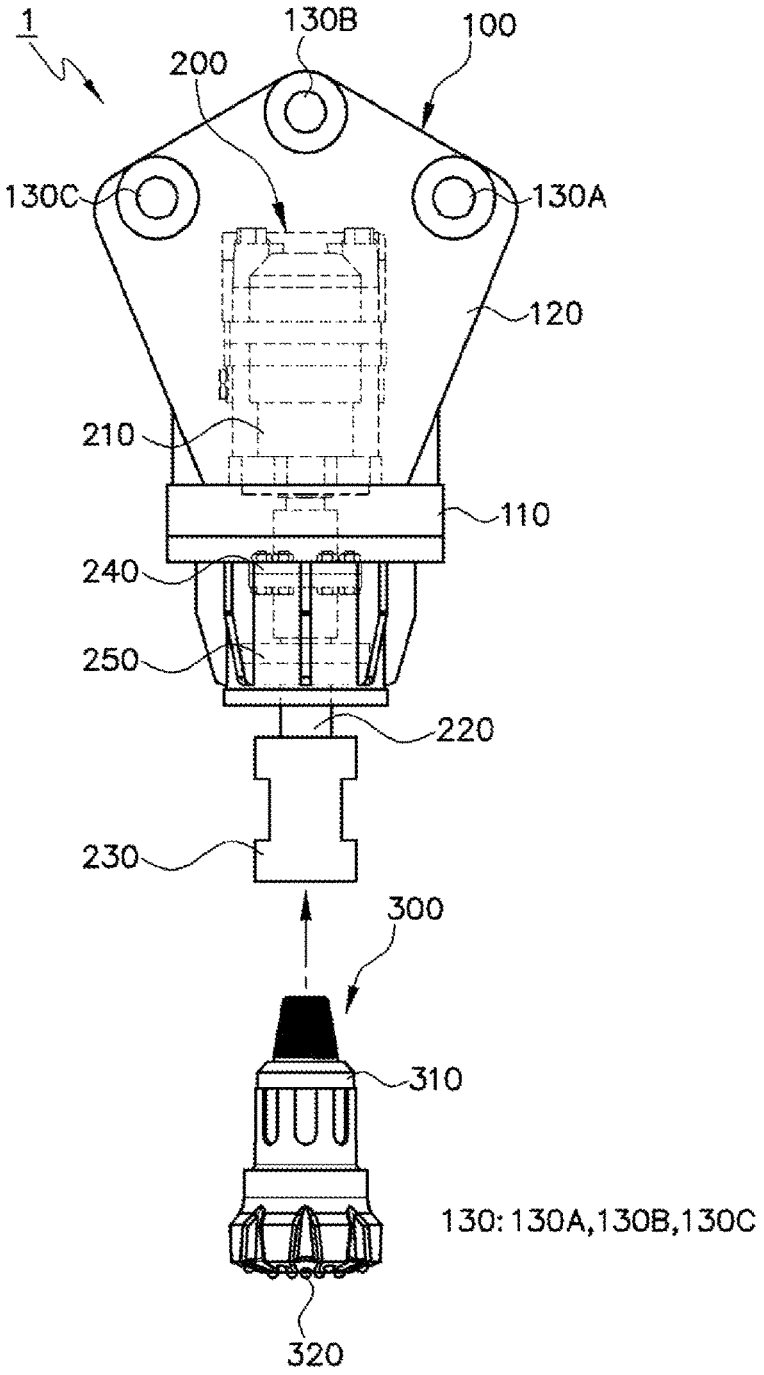
FIG. 4 is a side elevation view schematically showing the structure of the excavation assembly for use in the excavator according to the first embodiment of the present disclosure.

FIG. 3 is a perspective view illustrating the structure of the excavation assembly for use in the excavator according to the first embodiment of the present disclosure. FIG. 4 is a side elevation view schematically showing the structure of the excavation assembly for use in the excavator according to the first embodiment of the present disclosure.

As shown in FIG. 3 and FIG. 4, the excavation assembly 1 for use in the excavator according to the first embodiment of the present disclosure may include a body 100, a driving mechanism 200, and an excavation tool 300.

The driving mechanism 200 included in the excavation assembly 1 for use in the excavator according to the first embodiment of the present disclosure may be a driving mechanism 200 for generating a striking force in a linear direction. The excavation tool 300 may be a hammer boring tool 300 that reciprocates and performs a boring operation on the ground or rock using the striking force transmitted from the driving mechanism 200 generating the striking force.

The body 100 may be connected at one end thereof to the arm at the pair of spaced shaft-receiving portions 12 thereof in a detachable manner. As shown in FIG. 3, the body 100 may include a housing 110, a pair of lateral brackets 120, and shaft-type connectors 130. As shown in FIG. 3, the body 100 may be detachably coupled to the arm 11 at the pair of spaced shaft-receiving portions 12 defined in the arm 11 of the excavator 10 via the shaft-type connectors 130. A plurality of such shaft-type connectors 130 may be provided. For example, a first shaft-type connector 130A, a second shaft-type connector 130B, and a third shaft-type connector 130C may be provided as shown in FIG. 3. However, the number of the connectors may not be limited thereto. The working direction of the hammer boring tool 300 to be described later can be changed according to coupling positions between the shaft-type connectors 130 and the pair of spaced shaft-receiving portions 12. The specific structure of the body 100 will be described later in detail with respect to FIG. 5 and FIG. 6

The driving mechanism 200 generating the striking force may be installed inside the body 100 and can generate the striking force along the longitudinal direction of the body 100. FIG. As shown in FIG. 4, the driving mechanism 200 to generate the striking force may include a driver cylinder 210, a drive shaft 220, a connector member 230, a power transmission 240, and a support member 250. The driving mechanism 200 generates the striking force in a state where the driving mechanism 200 is installed inside the body 100, so that the hammer boring tool 300, which will be described later, can be reciprocated to perform the boring operation. The specific structure of the driving mechanism 200 generating the striking force will be described later in detail with reference to FIG. 5 and FIG. 6.

Figure 5:
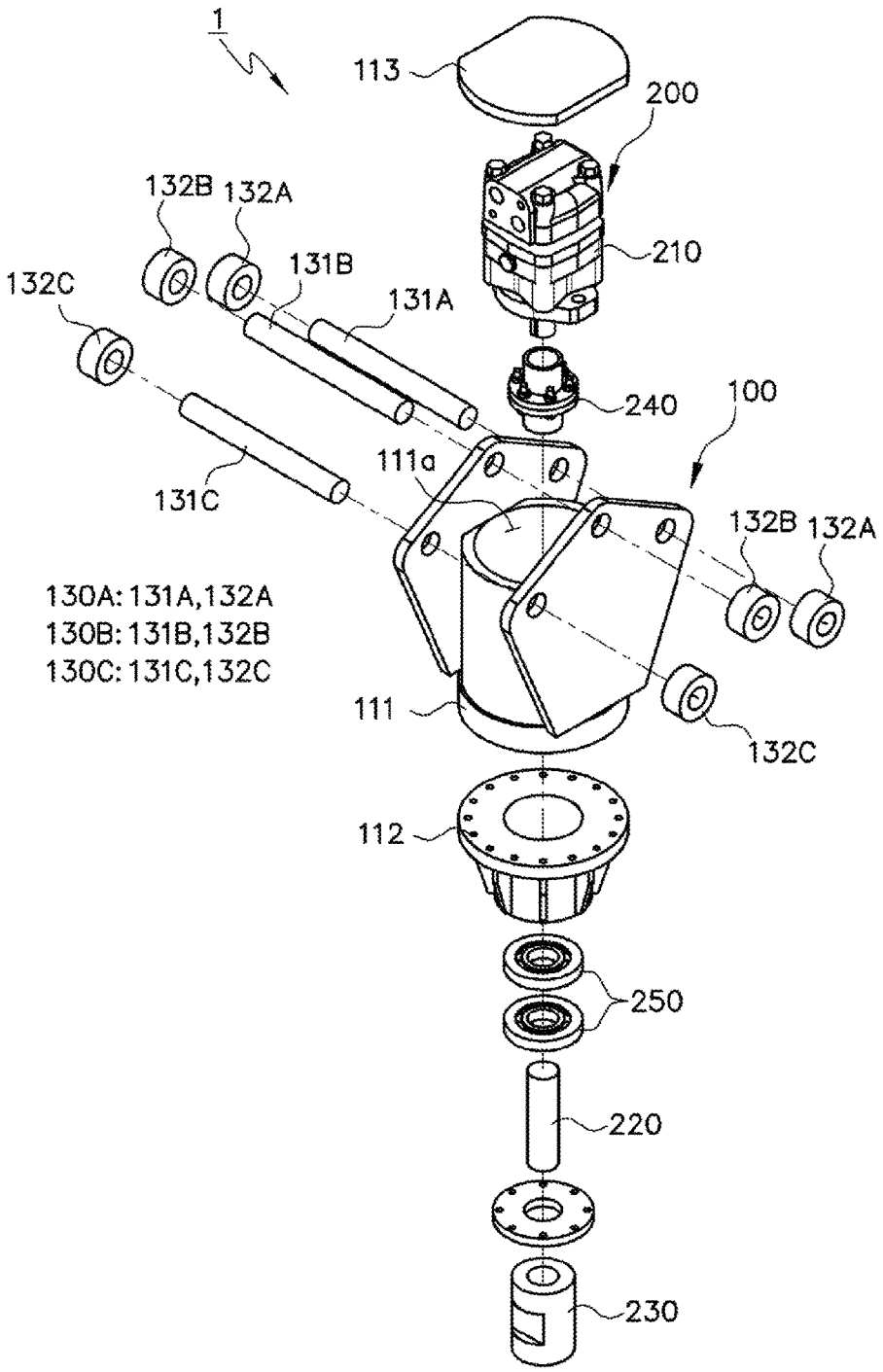
FIG. 5 is an exploded perspective view showing the structure of the body and the driving mechanism to generate the striking force in the excavation assembly for use in the excavator according to the first embodiment of the present disclosure.

The hammer boring tool 300 may be connected to the driving mechanism 200 at a portion thereof exposed through the other end of the body 100. The hammer boring tool 300 may receive the striking force from the driving mechanism 200 generating the striking force and, thus, may reciprocate to perform a boring operation on the rock or ground. FIG. As shown in FIG. 5, the hammer boring tool 300 may include a striking tool body 310 and a plurality of boring bits 320, for example, three boring bits 320A, 320B, and 320C. The hammer boring tool 300 can be reciprocated in response to the striking force from the driver cylinder 210 in a state when the tool 300 is coupled to the connector member 230 of the driving mechanism 200, thereby to generate the striking force. The detailed structure of the hammer boring tool 300 will be described later in detail with reference to FIG. 14.

The operation direction of the hammer boring tool 300 of the excavation assembly 1 for use in the excavator according to the first embodiment of the present disclosure may vary depending on the coupling positions between the shaft-type connectors 130 of the body 100 and the pair of spaced shaft-receiving portions 12 defined in the arm 11. The body 100 may be coupled to the arm 11 at the pair of spaced shaft-receiving portions 12 defined by the arms 11 of the excavator 10 via the plurality of shaft-type connectors 130, as described above. In this connection, the installation direction of the body 100 may be changed according to the coupling positions between the pair of spaced shaft-receiving portions 12 and the shaft-type connectors 130, thereby changing the working direction of the hammer boring tool 300. In this connection, an example in which the working direction of the hammer boring tool 300 is changed according to the joint positions between the pair of spaced shaft-receiving portions 12 and the shaft-type connectors 130 will be described later in detail with reference to FIG. 8 and FIG. 9.

Hereinafter, with reference to FIG. 5 and FIG. 6, the structure of the body 100 and the driving mechanism 200 to generate the striking force in the excavation assembly 1 for use in the excavator according to the first embodiment of the present disclosure will be described in detail.

FIG. 5 is an exploded perspective view showing the structure of the body and the driving mechanism to generate the striking force in the excavation assembly for use in the excavator according to the first embodiment of the present disclosure. FIG. 6 is a vertical sectional view showing the structure of the body and the driving mechanism to generate the striking force in the excavation assembly for use in the excavator according to the first embodiment of the present disclosure.

Figure 6:
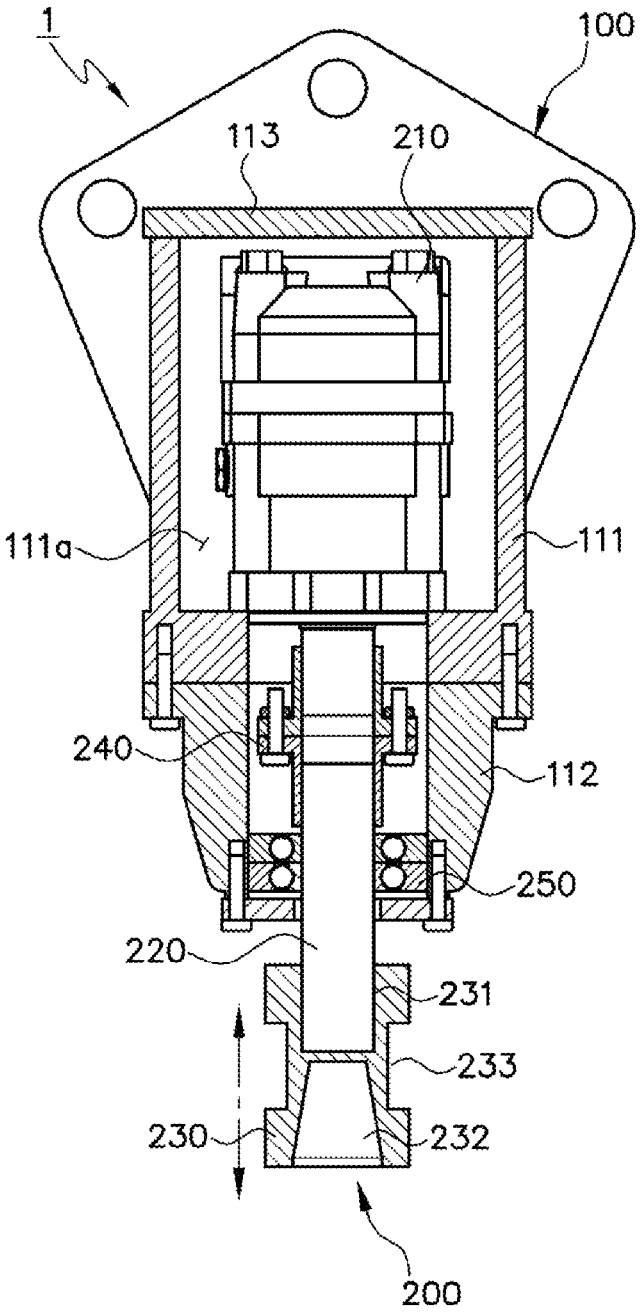
FIG. 6 is a vertical sectional view showing the structure of the body and the driving mechanism to generate the striking force in the excavation assembly for use in the excavator according to the first embodiment of the present disclosure.

As shown in FIG. 5 and FIG. 6, the body 100 may include the housing 110, the pair of lateral brackets 120, and the shaft-type connectors 130.

The housing 110 forms a basic frame of the body 100. The housing may have a receiving space 111*a* defined therein to accommodate the driving mechanism 200 to generate the striking force therein. On both sides of the housing 110, the pair of lateral brackets 120 may be respectively provided facing each other. FIG. As shown in FIG. 5, the housing 110 may include a base body 111, a connection body 112, and a body cover 113.

The base body 111 is opened at the top and bottom portions thereof and along the reciprocating direction of the drive shaft 220. On both sides of the base body 111, the pair of lateral brackets 120 may be provided. As shown in FIG. 6, the base body 111 has a substantially cylindrical shape so as to have a hollow portion penetrating up and down. The base body 111 may have a coupling step formed thereon to mount the driver cylinder 210 to be described later.

As shown in FIG. 5, the pair of lateral brackets 120 each has a substantially thin plate shape and may be attached to the outer peripheral surface of the base body 111 having the cylindrical shape. In this connection, the pair of lateral brackets 120 each may have a polygonal cross-section. In this regard, the cross-sectional shape of each of lateral brackets 120 may be determined by the number and arrangement of the shaft-type connectors 130 according to the direction of operation.

As shown in FIG. 5, there are three shaft-type connectors 130. The first shaft-type connector 130A, the second shaft-type connector 130B, and the third shaft-type connector 130C are arranged in an angular arrangement of about 120 degrees with the second shaft-type connector 130B located between the first and third connectors. Each of the lateral brackets 120 may have a pentagonal cross-section. The present disclosure is not limited thereto. The arrangement and number of the connectors and the shape of the bracket may be changed by a person skilled in the art.

Although, in FIG. 5, the base body 111 and the pair of lateral brackets 120 are integrally formed, the present disclosure is not limited thereto. The base body 111 and the pair of lateral brackets 120 may be fabricated separately and assembled by welding, screwing, or the like.

The connection body 112 is open at the top and bottom thereof. When the connection body 112 is coupled to the lower end of the base body 111, the connection body 112 may form the receiving space 111*a* together with the base body 111. The body cover 113 may close the open top of the base body 111 when the driver cylinder 210 is coupled to the base body 111.

As shown in FIG. 5 and FIG. 6, the body 100 may include the shaft-type connectors 130, each extending between the lateral brackets 120 at the top of the housing 110. The shaft-type connectors 130 includes, for example, the first shaft-type connector 130A, the second shaft-type connector 130B, and the third shaft-type connector 130C. Depending on the joint positions between the pair of spaced shaft-receiving portions 12 and the shaft-type connectors 130, the working direction of the hammer boring tool 300 may be changed. In this connection, the shaft-type connectors 130 may be arranged at a spacing corresponding to the spacing between the pair of spaced shaft-receiving portions 12, preferably at the same spacing as the spacing between the spaced shaft-receiving portions 12.

As shown in FIG. 5, each of the plurality of shaft-type connectors 130 has the shape of an elongate cylindrical shaft 131A, 131B, and 131C to be engaged in each of the spaced shaft-receiving portions 12. In addition, the plurality of shaft-type connectors 130 may respectively have fixing members 132A, 132B, and 132C, such as nuts, at one or both ends of the elongate cylindrical shafts 131A, 131B, and 131C so as to be inserted into and detached from the pair of the lateral brackets 120. In this case, the cylindrical shafts 131A, 131B and 131C as the plurality of shaft-type connectors 130 are inserted through the through-holes formed in the pair of lateral brackets 120, and then one end or both ends thereof are fixed to the pair of lateral brackets 120 using the fixing members 132A, 132B and 132C.

Preferably, at least three shaft-type connectors 130 may be provided. Two adjacent shaft-type connectors 130 of at least three shaft-type connectors 130 are selectively fastened to the pair of spaced shaft-receiving portions 12 respectively, whereby the boring working direction of the hammer boring tool 300 may be determined based on the fastening positions therebetweeen.

In one embodiment, in order to implement n different working directions, (n+1) shaft-type connectors 130 may be sequentially and spacedly arranged with each spacing corresponding to the spacing between the pair of spaced shaft-receiving portions 12. In this connection, it is not preferable that among the (n+1) shaft-type connectors 130, adjacent three shaft-type connectors 130 may be arranged in a straight line. That is, among the (n+1) shaft-type connectors 130, any three adjacent shaft-type connectors 130 may be preferably arranged in an angular arrangement less than 180 degrees.

In FIG. 6, the first shaft-type connector 130A, the second shaft-type connector 130B, and the third shaft-type connector 130C are arranged in an angular arrangement of about 120 degrees However, this is merely an example. The present disclosure is not limited thereto. The angular arrangement between the three adjacent shaft-type connectors 130 can be varied by the person skilled in the art.

FIG. 3 to FIG. 6 show an example in which the three shaft-type connectors 130 are provided. In FIG. 3 to FIG. 6, the first shaft-type connector 130A and the second shaft-type connector 130B may be selected and coupled to the pair of spaced shaft-receiving portions 12 respectively according to a desired first working direction. In an alternative, the second shaft-type connector 130B and third shaft-type connector 130C may be selected and coupled to the pair of spaced shaft-receiving portions 12 respectively according to a desired second working direction. Thus, the working direction of the hammer boring tool 300 can be selectively determined.

Although FIG. 3 to FIG. 6 show an example in which the three shaft-type connectors 130 are provided, that is, the first shaft-type connector 130A, second shaft-type connector 130B, third shaft-type connector 130C are provided, this is only an example. The present disclosure is not limited thereto, and, hence, the number and arrangement of the shaft-type connectors 130 can be changed by a person skilled in the art based on a desired working direction.

As described above, the excavation assembly 1 for use in the excavator according to the first embodiment of the present disclosure may allow the working direction of the working tool coupled to the body 100 to be changed via a selection of the coupling positions between the plurality of shaft-type connectors 130 provided on the body 100 and the pair of spaced shaft-receiving portions 12 defined in the arm 11. This allows easy adjustment of the working direction of the hammer boring tool 300 as desired, without adjustment limitation by the location of the excavator 10, the working radius of the arm 11 provided in the excavator 10, and the like.

As shown in FIG. 5 and FIG. 6, the driving mechanism 200 to generate the striking force may include the driver cylinder 210, the drive shaft 220, the connector member 230, the power transmission 240 and the support member 250.

The driver cylinder 210 may be mounted into the accommodation space 111*a* defined in the housing 110 of the body 100 and can generate the striking force. As shown in FIG. 6, the driver cylinder 210 may be mounted onto the mounting step formed on the base body 111 of the housing 110 and may fixed thereto using a fastening member such as a bolt.

Preferably, the driver cylinder 210 may be implemented as a hydraulic cylinder driven using oil supplied from the excavator. As such, the excavation assembly 1 for use in the excavator according to the first embodiment of the present disclosure employs the driver cylinder 210 provided in the driving mechanism 200 as the hydraulic cylinder, so that the driving mechanism 200 to generates the striking force may be smaller while the power required for the boring operation can be sufficiently obtained. In this example, the driver cylinder 210 is implemented as the hydraulic cylinder, but the present disclosure is not limited thereto. It is apparent to those skilled in the art that the driver cylinder may alternatively be implemented as various types of actuator cylinders, such as a pneumatic cylinder.

The drive shaft 220 is connected at one end thereof to a driver shaft of the driver cylinder 210. The drive shaft 220 receives the striking force from the driver cylinder 210 and, thus, is reciprocated. In addition, the connector member 230 has one end 231 thereof coupled to the other end of the drive shaft 220, and the hammer boring tool 300 is detachably coupled to the other end 232 thereof. The connector member 230 may reciprocally drive the hammer boring tool 300 using the striking force transmitted from the drive shaft 220. Although not shown in detail, one end 231 and the other end 232 of the connector member 230 may be threaded so that the drive shaft 220 and the hammer boring tool 300 may be thread-engaged therewith respectively. In addition, a coupling groove 233 may be defined in the outer circumferential surface of the connector member 230 to facilitate tightening or loosening of the threads when the drive shaft 220 and the hammer boring tool 300 are thread-engaged or thread-disengaged with the connector member 230.

As shown in FIG. 6, the drive shaft 220 may be oriented so that the drive shaft of the driver cylinder 210 and the drive shaft 220 are in a line. However, if necessary, the drive shaft of the driver cylinder 210 and the drive shaft 220 may be not be arranged in a line.

The driving mechanism 200 further includes the power transmission 240 power-connecting the drive shaft of the driver cylinder 210 with the drive shaft 220 to transmit the striking force from the driver cylinder 210 to the drive shaft 220. FIG. 6 shows an example of using a flange coupling as the power transmission 240 for power-connecting the drive shaft 210 and the drive shaft 220. However, the present disclosure is not limited thereto. Other types of the power transmission may be possible to a person skilled in the art.

The driving mechanism 200 to generate the striking force further includes a support member 250 for supporting the reciprocating movement of the drive shaft 220. FIG. 6 shows an example in which a pair of thrust bearings is used as the support member 250 for supporting the reciprocating movement of the drive shaft 220. However, the present disclosure is not limited thereto. Other types of the support member may be possible to a person skilled in the art.

Hereinafter, referring to FIG. 7, the structure of the hammer boring tool 300 in the excavation assembly 1 for use in the excavator according to the first embodiment of the present disclosure will be described in detail.

Figure 7:
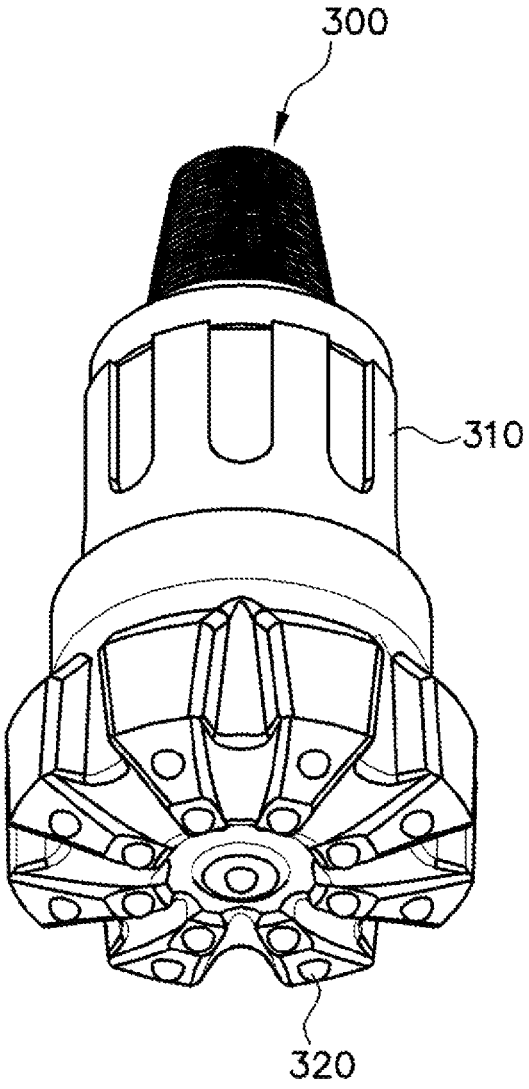
FIG. 7 is a perspective view showing the structure of the hammer boring tool in the excavation assembly for use in the excavator according to the first embodiment of the present disclosure.

FIG. 7 is a perspective view showing the structure of the hammer boring tool in the excavation assembly for use in the excavator according to the first embodiment of the present disclosure.

As shown in FIG. 7, the hammer boring tool 300 may include the striking tool body 310 and the plurality of boring bits 320.

The striking tool body 310 may be detachably coupled, at one end thereof, to one end of the driving mechanism to generate the striking force. In addition, the plurality of boring bits 320 may be radially formed on the surface of the striking tool body 310 abutting the ground or rock. The plurality of boring bits 320 may be made of tungsten or alloy steel. In addition, the plurality of boring bits 320 are preferably arranged in a circular array at the same angular spacing on the same plane on one side facing the working direction. FIG. 7 shows an example in which each of a plurality of boring bits 320 is formed in a substantially semi-spherical shape. However, this is an exemplary one. Each of a plurality of boring bits 320 may be formed in various shapes such as a conical shape, a rectangular parallelepiped, and a quadrangular pyramid.

As described above, in the excavation assembly 1 for the excavator according to the first embodiment of the present disclosure, the boring operation direction of the hammer boring tool 300 can be changed based on the joining positions between the shaft-type connectors 130 of the body 100 and the pair of spaced shaft-receiving portions 12.

Hereinafter, Referring to FIG. 8 and FIG. 10, the operation of the excavation assembly 1 for use in the excavator according to the first embodiment of the present disclosure will be described in detail.

Figure 8:
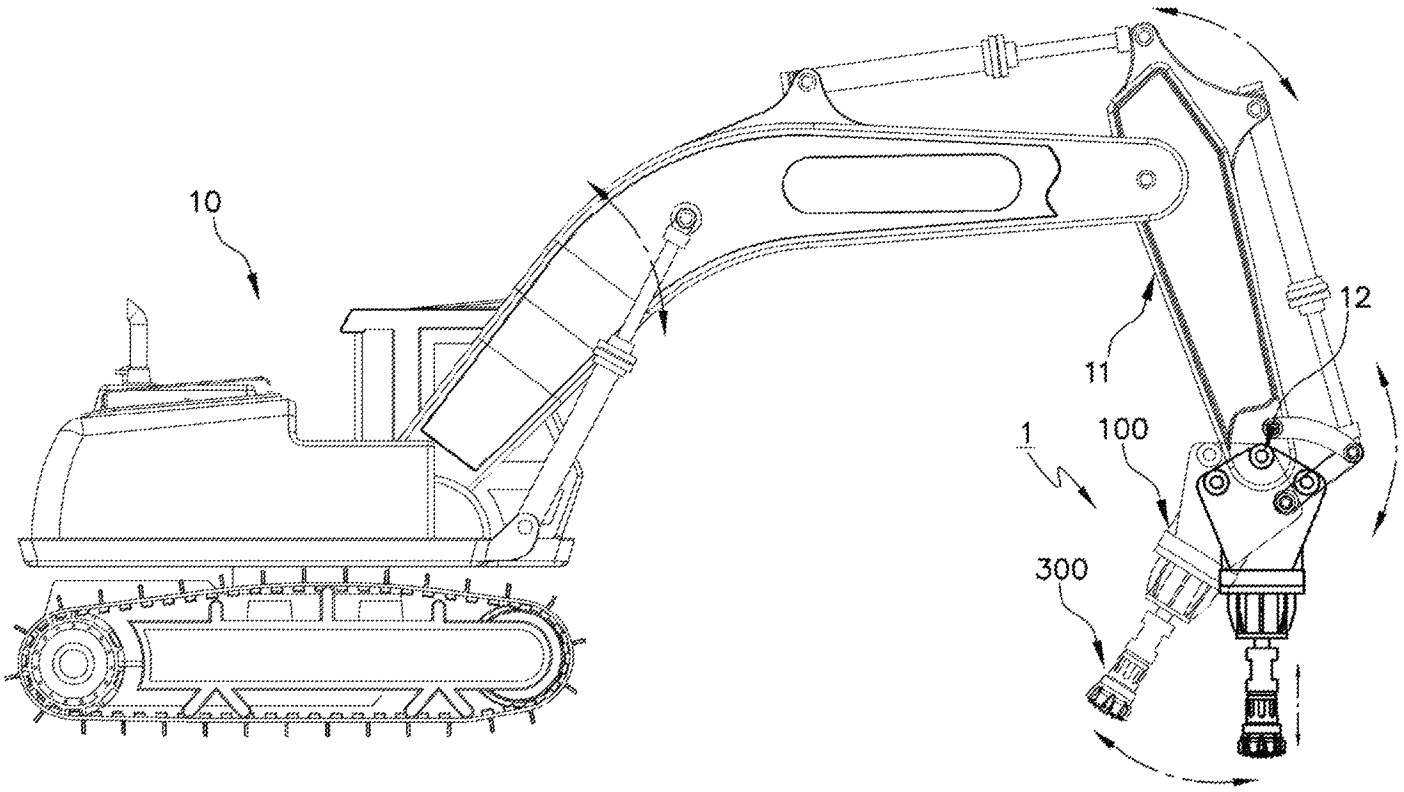
FIG. 8 is a view showing an example in which the excavation assembly for the excavator according to the first embodiment of the present disclosure is installed in a general excavator to perform a boring operation.
Figure 9:
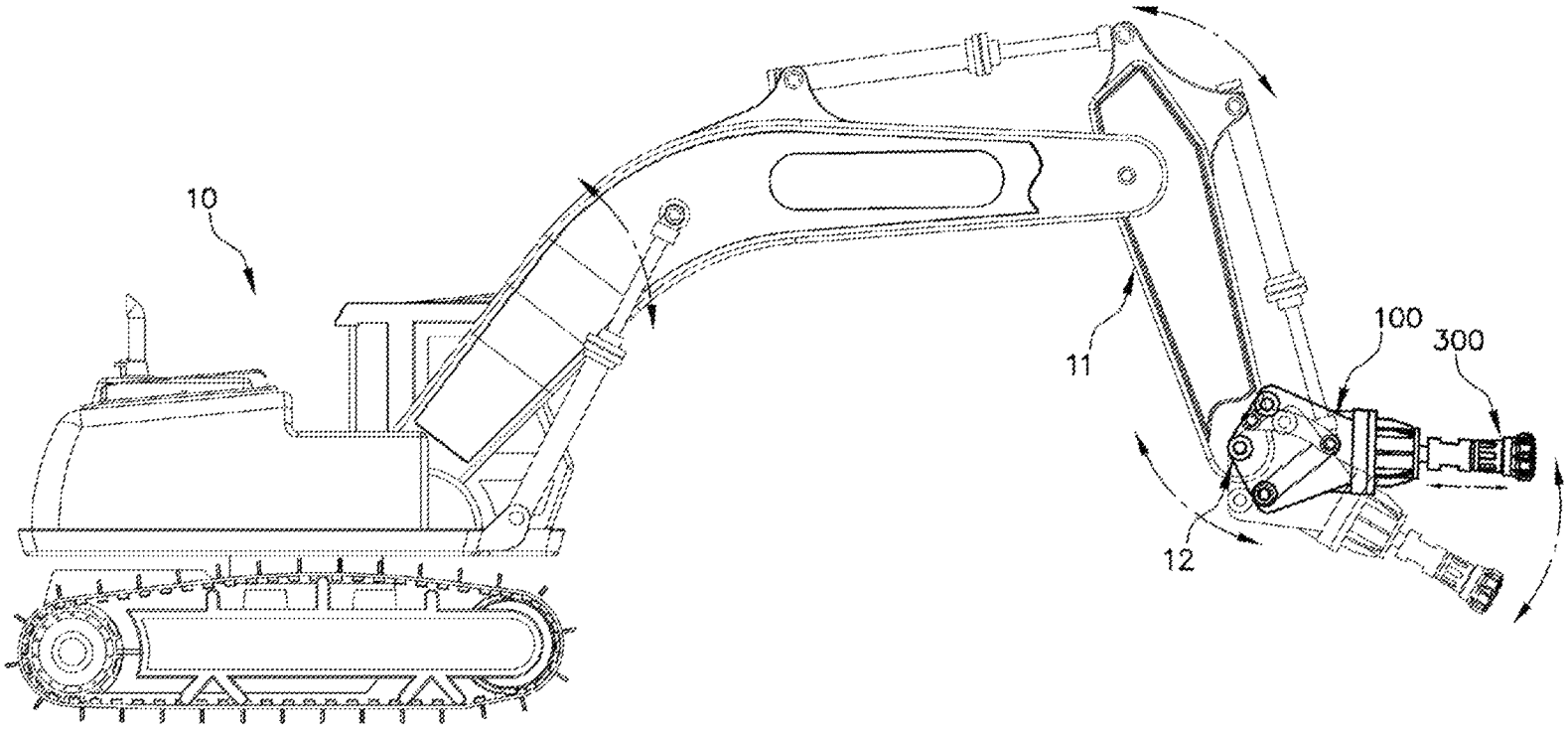
FIG. 9 is a view showing another example in which the excavator according to the first embodiment of the present disclosure is installed in a general excavator to perform a boring operation.

FIG. 8 is a view showing an example in which the excavation assembly for the excavator according to the first embodiment of the present disclosure is installed in a general excavator to perform a boring operation. FIG. 9 is a view showing another example in which the excavator according to the first embodiment of the present disclosure is installed in a general excavator to perform a boring operation.

FIG. 8 shows an example where, in the example of the excavation assembly 1 for use in the excavator shown in FIG. 3, the adjacent first shaft-type connector 130A and the second shaft-type connector 130B among the three shaft-type connectors 130 provided in the body 100 are selected and coupled to the pairs of spaced shaft-receiving portions 12 respectively. FIG. 9 shows another example where, in the example of the excavation assembly 1 for use in the excavator shown in FIG. 3, the adjacent second shaft-type connector 130B and the third shaft-type connector 130C among the three shaft-type connectors 130 provided in the body 100 are selected and coupled to the pairs of spaced shaft-receiving portions 12 respectively.

As shown in FIG. 8, when the first shaft-type connector 130A and the second shaft-type connector 130B among the three shaft-type connectors 130 provided in the body 100 are selected and coupled to the pair of spaced shaft-receiving portions 12 respectively, the hammer boring tool 300 directs perpendicularly toward the ground or rock at the initial position of the arm 11 provided in the excavator 10. Therefore, it is possible to easily carry out a boring operation toward the horizontal plane such as a ground or a rock.

To the contrary, as shown in FIG. 9, when the second shaft-type connector 130B and the third shaft-type connector 130C among the three shaft-type connectors 130 provided in the body 100 are selected and coupled to the pair of spaced shaft-receiving portions 12 respectively, the hammer boring tool 300 directs toward a front direction, that is, directs perpendicularly toward a vertical wall at the initial position of the arm 11 provided in the excavator 10. Therefore, it is possible to easily carry out a boring operation toward the vertical plane such as a tunnel vertical side wall.

Hereinafter, Referring to FIG. 10 and FIG. 11, the excavation assembly for use in the excavator according to the second embodiment of the present disclosure will be described.

Figure 10:
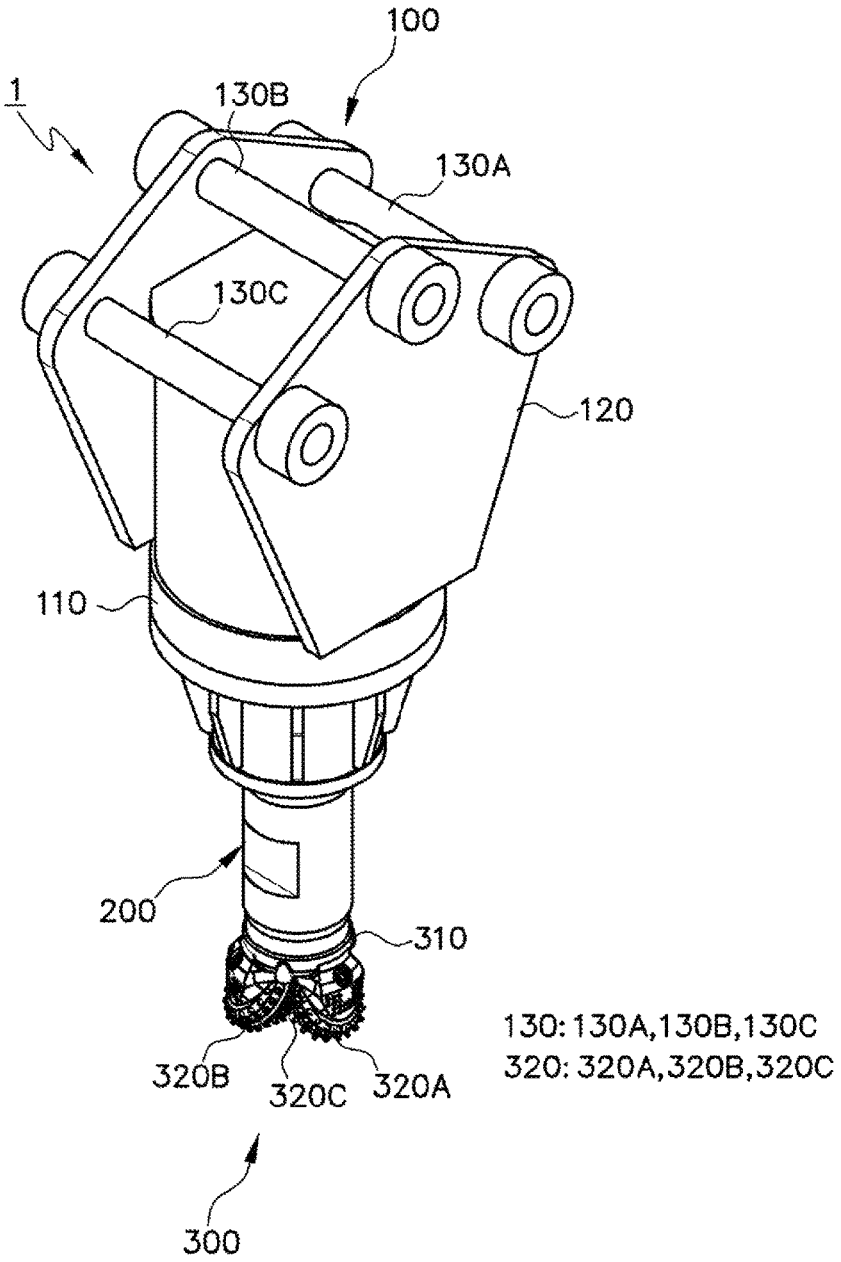
FIG. 10 is a perspective view showing the structure of the excavation assembly for use in the excavator according to the second embodiment of the present disclosure.

FIG. 10 is a perspective view showing the structure of the excavation assembly for use in the excavator according to the second embodiment of the present disclosure. FIG. 11 is a vertical sectional view showing the structure of a body and a rotation-driving mechanism in the excavation assembly for use in the excavator according to the second embodiment of the present disclosure.

Figure 11:
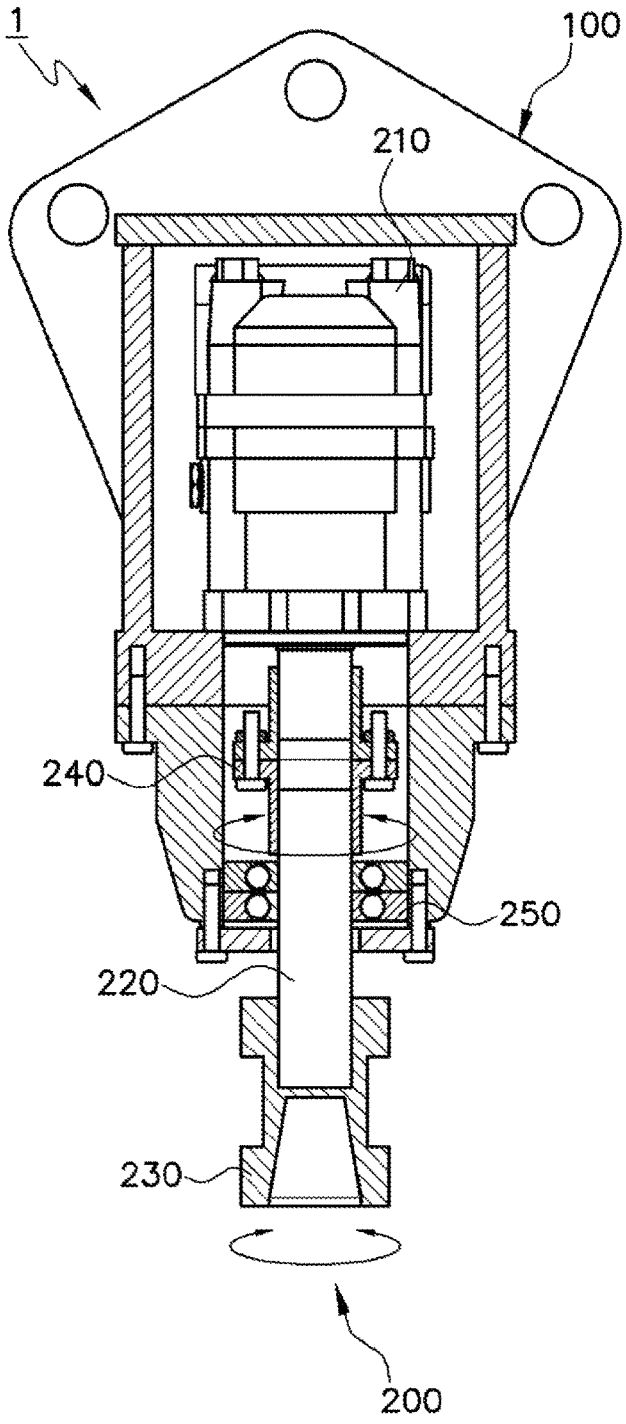
FIG. 11 is a vertical sectional view showing the structure of a body and a rotation-driving mechanism in the excavation assembly for use in the excavator according to the second embodiment of the present disclosure.

As shown in FIG. 10 and FIG. 11, the excavation assembly 1 for use in the excavator according to the second embodiment of the present disclosure may include the body 100, a rotation-driving mechanism 200, and an excavation tool 300.

The driving mechanism 200 constituting the excavation assembly 1 for use in the excavator according to the second embodiment of the present disclosure, which is different from the excavation assembly 1 for use in the excavator according to the first embodiment of the present disclosure shown in FIG. 3 may be embodied as the rotation-driving mechanism 200 to generates a rotation-driving force. In addition, the excavation tool 300 may be implemented as the boring tool 300 that rotates by the rotational driving force transmitted from the rotation-driving mechanism 200, thereby performing a boring operation on the ground or rock.

The body 100 may be connected at one end thereof to the arm at the pair of spaced shaft-receiving portions 12 defined in the arm in a detachable manner. The body 100 constituting the excavation assembly 1 for use in the excavator according to the second embodiment of the present disclosure has substantially the same structure as the body 100 constituting the excavation assembly 1 for use in the excavator according to the first embodiment of the present disclosure shown in FIG. 5. Thus, a detailed description thereof will be omitted.

The rotation-driving mechanism 200 may installed inside the body 100 and can generate the rotational driving force. As shown in FIG. 11, the rotation-driving mechanism 200 may include a drive motor 210, a drive shaft 220, a connector member 230, a power transmission 240, and a support member 250. The rotation-driving mechanism 200 may be installed inside the body 100 to generate the rotational driving force to rotate the boring tool 300 to perform the boring operation.

The boring tool 300 may be connected to the portion of the rotation-driving mechanism 200 exposed through the other end of the body 100. The tool 300 may be rotated by the rotational driving force transmitted from the rotation-driving mechanism 200 to perform the boring operation on the ground or the rock. As shown in FIG. 10, the boring tool 300 may include a rotatable body 310 and a plurality of boring bits 320, for example, three boring bits 320A, 320B, and 320C. The boring tool 300 may be coupled to the connector member 230 of the rotation-driving mechanism 200 and, hence, may be rotated upon receiving the rotational driving force of the drive motor 210.

As described above, in the excavation assembly 1 for use in the excavator according to the second embodiment of the present disclosure, the boring operation direction of the boring tool 300 may vary depending on the joining positions between the shaft-type connectors 130 of the body 100 and the pair of spaced shaft-receiving portions 12.

Hereinafter, referring to FIG. 12, the excavation assembly for use in the excavator according to the third embodiment of the present disclosure will be described.

Figure 12:
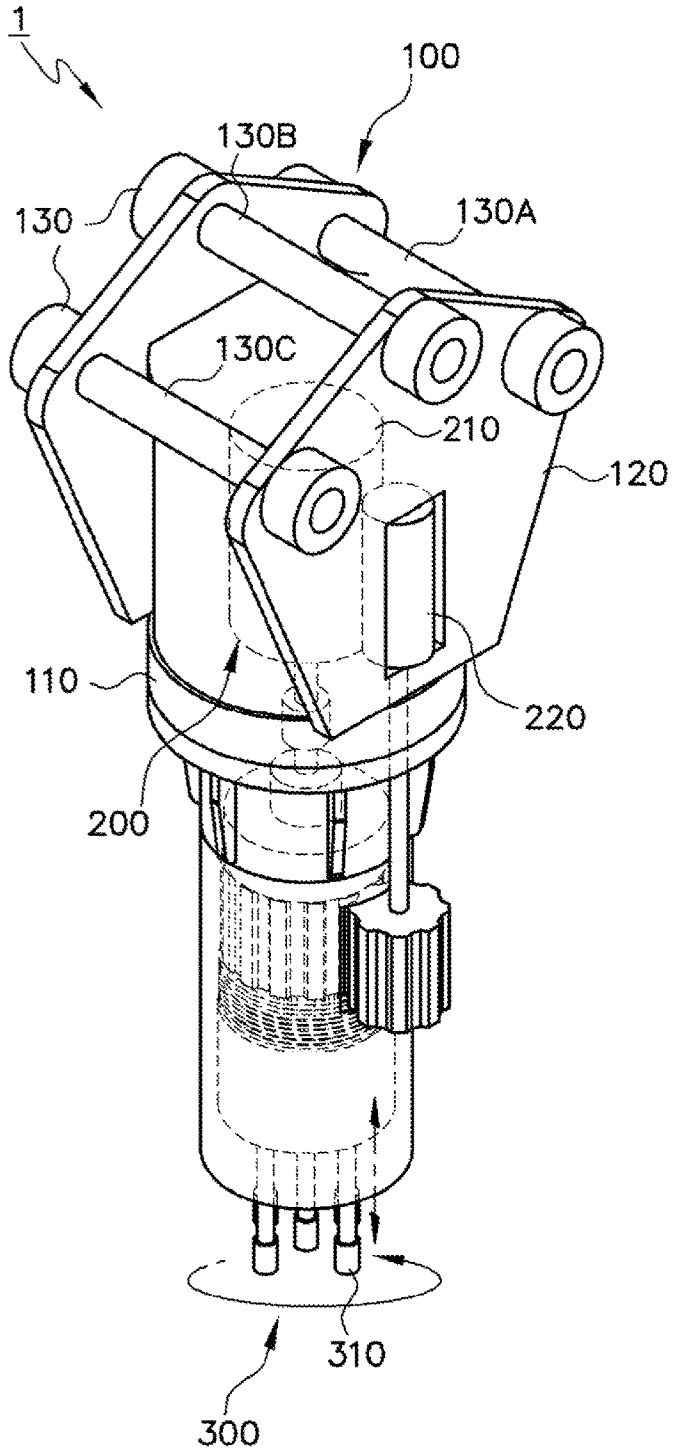
FIG. 12 is a perspective view illustrating a structure of the excavation assembly for use in the excavator according to the third embodiment of the present disclosure.

FIG. 12 is a perspective view illustrating a structure of the excavation assembly for use in the excavator according to the third embodiment of the present disclosure.

As shown in FIG. 12, the excavation assembly 1 for use in the excavator according to the third embodiment of the present disclosure may include a body 100, a driving mechanism 200, and an excavation tool 300.

Referring to FIG. 12, the excavation tool 300 constituting the excavation assembly 1 for use in the excavator according to the third embodiment of the present disclosure may be rotatably installed inside the body 100 and may be arranged along the longitudinal direction of the body 100. The excavation tool 300 may be embodied as a rotational drilling unit 300 having a plurality of drill blades or chisels 310 exposed to the outside through the other end of the body 100 to perform excavation work on the ground or rock. The driving mechanism 200 may include a striking force-driving mechanism 210 and a rotation-driving mechanism 220. The striking force-driving mechanism 210 may be installed inside the body 100 and may be configured to hit one side of the rotational drilling unit 300 to apply a striking force to the plurality of drill blades 310. The rotation-driving mechanism 220 may be installed inside or on one side of the body 100 and may be configured to apply a rotational driving force to the rotational drilling unit 300.

Hereinafter, referring to FIG. 13 to FIG. 15, the structure of an excavator 2 to which the excavation assembly for use in the excavator according to the above embodiments of the present disclosure will be mounted will be described in detail.

Figure 13:
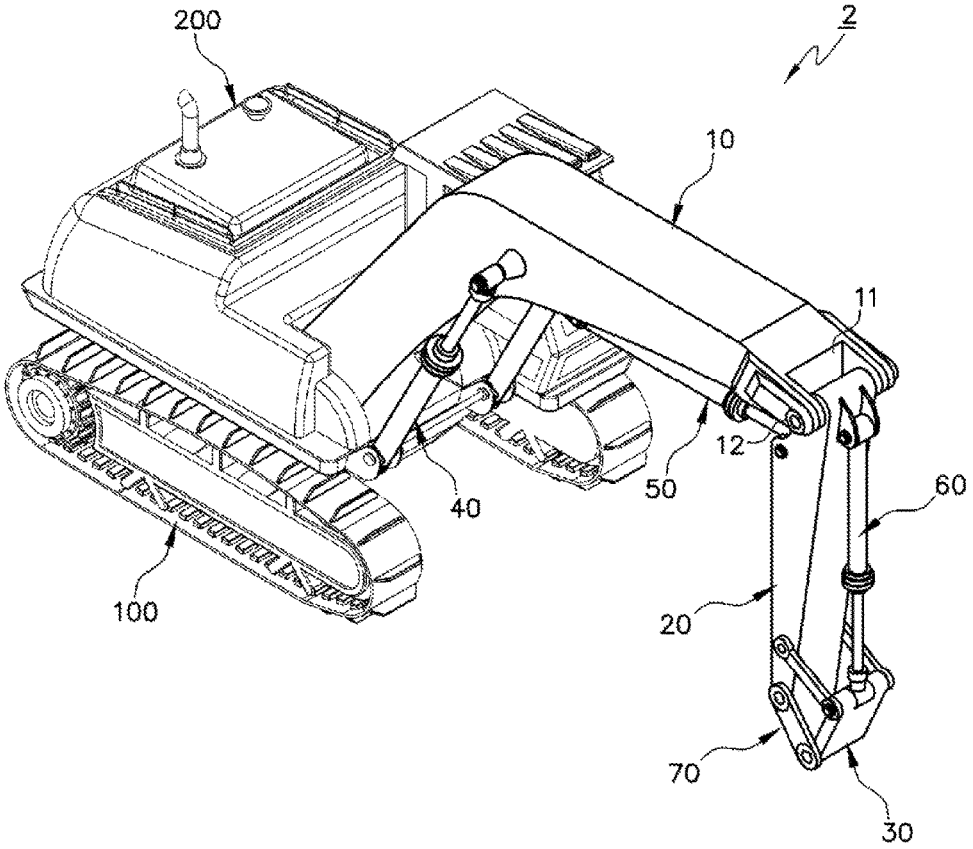
FIG. 13 is a perspective view schematically showing the structure of the excavator to which the excavation assembly for use in the excavator according to the above-described embodiments of the present disclosure is to be mounted.

FIG. 13 is a perspective view schematically showing the structure of the excavator to which the excavation assembly for use in the excavator according to the above-described embodiments of the present disclosure is to be mounted. FIG. 14 is a side elevation view schematically showing the structure of the excavator in FIG. 13. FIG. 15 is a bottom view schematically showing the structure of the excavator in FIG. 13. FIG. 16 is a bottom view schematically showing the structure when a plurality of first arm cylinders are provided in the excavator in FIG. 13.

Figure 14:
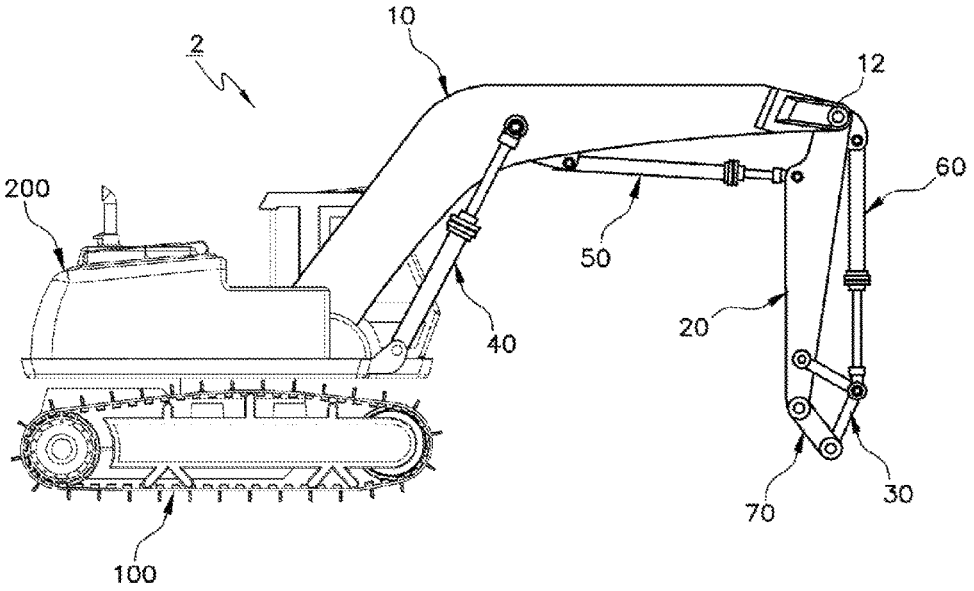
FIG. 14 is a side elevation view schematically showing the structure of the excavator in FIG. 13.
Figure 15:
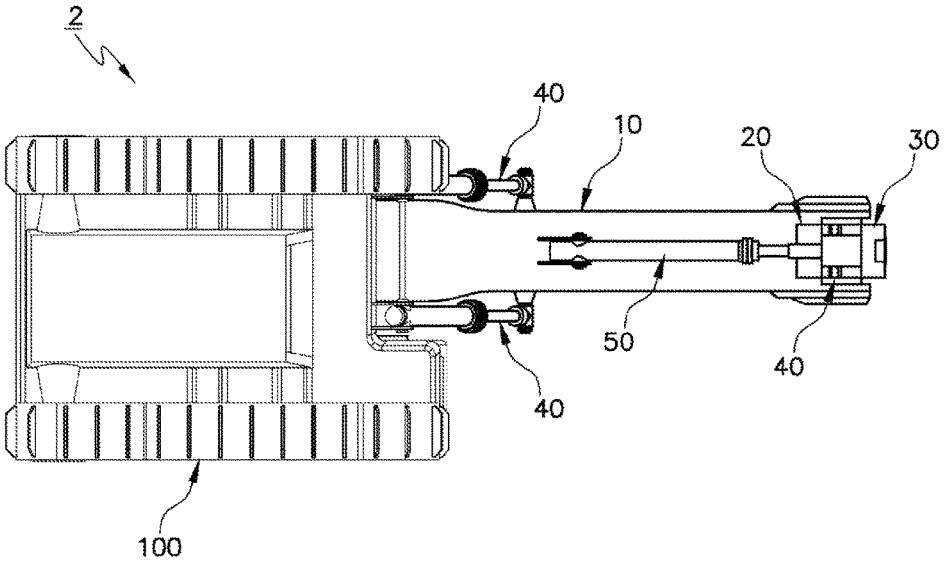
FIG. 15 is a bottom view schematically showing the structure of the excavator in FIG. 13.
Figure 16:
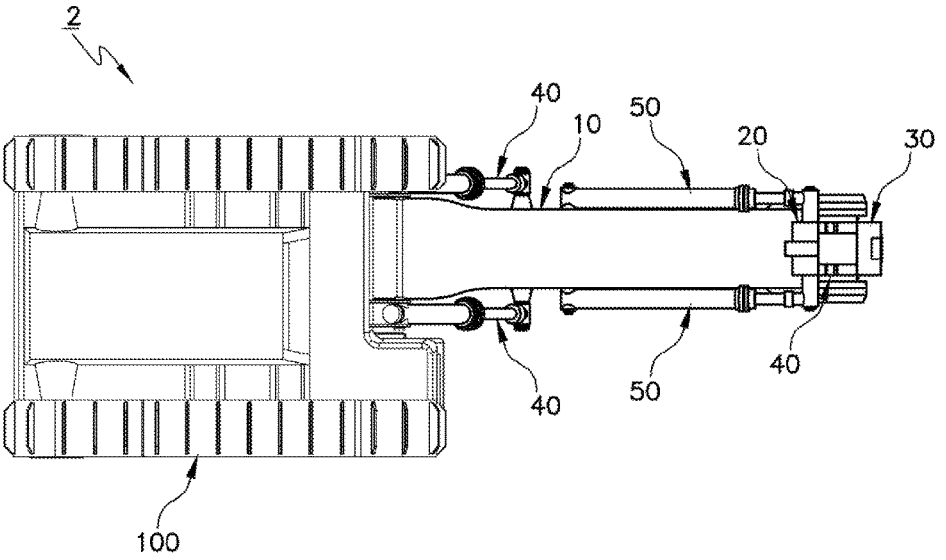
FIG. 16 is a bottom view schematically showing the structure when a plurality of first arm cylinders are provided in the excavator in FIG. 13.

As shown in FIG. 13 to FIG. 15, the excavator 2 to which the excavation assembly for use in the excavator according to the above-described embodiments of the present disclosure is to be mounted may include a traveling system 100 including an endless chain or wheels, an upper revolving structure 200 mounted on the traveling system 100 and configured to rotate 360 degrees, and having a cab and a machine room, a boom 10, a first arm 20, a second arm 30, a boom cylinder 40, a first arm cylinder 50, and a second arm cylinder 60.

The boom 10 may have one end pivotally coupled to the upper revolving structure 200. The boom 10 may be pivoted up and down by the boom cylinder 40 described below.

The first arm 20 may have one end pivotally coupled to the other end of the boom 10. One end of the first arm 20 is inserted into the cut-out portion 11 formed in the other end of the boom 10 to a certain depth, and then may be pivotally coupled to the boom 10 by a pivot shaft 12. The first arm 20 may be pivoted back and forth with respect to the upper revolving structure 200 by a first arm cylinder 50, described below The second arm 30 may be pivotally coupled to the other end of the first arm 20 at one end of the arm 30. Although the second arm 30 is provided as a pair of links and is connected to a second arm cylinder 60 to be described later, the present disclosure is not limited thereto. The shape, number and arrangement of the second arm 30 may be changed by a person skilled in the art.

The pair of spaced shaft-receiving portions 70 may be defined in the other end of the first arm 20 and the other end of the second arm 30. The pair of spaced shaft-receiving portions 70 may be removably coupled to the excavation assembly (FIG. 3, FIG. 10, FIG. 12). The excavation assembly (FIG. 3, FIG. 10, FIG. 12) may be connected to a second arm cylinder 60 via the second arm 30 coupled to the pair of spaced shaft-receiving portions 70 and thus, may be driven by the second arm cylinder 60.

As described above, the excavation assembly (FIG. 3, FIG. 10, FIG. 12) detachably coupled to the pair of spaced shaft-receiving portions 70 includes the body 100, the driving mechanism 200, the excavation tool 300. The excavation assembly (FIG. 3, FIG. 10, FIG. 12) may be detachably connected to the pair of spaced shaft-receiving portions 70 via the shaft-type connectors 130 provided in the body 100.

As shown in FIG. 3, FIG. 10 and FIG. 12, the excavation tool 300 may be implemented as either a boring tool, a hammer tool, or a chisel. The driving mechanism 200 can generate at least one of a linear driving force, a rotational driving force, and a striking force for driving the excavation tool 300.

The boom cylinder 40 connects the upper revolving structure 200 and the boom 10, and articulates the boom 10. The first arm cylinder 50 connects the boom 10 to the first arm 20, and the first arm 20 can be articulated by the cylinder 50. The second arm cylinder 60 connects the first arm 20 to the second arm 30, and the second arm 30 can be articulated by the cylinder 60. On the other hand, the first arm cylinder 50 may be placed under the bottom of the boom 10. According to the present disclosure, since the first arm cylinder 50 of the excavator 2 is disposed below the bottom of the boom 10 rather than above the top of the boom 10 as in the conventional excavator, it is possible to smoothly perform the excavation work even in a workplace with a narrow space such as a tunnel.

Preferably, the boom cylinder 40, the first arm cylinder 50, and the second arm cylinder 60 each may be implemented as a hydraulic cylinder driven by a working fluid. In this example, a hydraulic cylinder is exemplified. However, it is apparent to those skilled in the art that various types of actuators such as a pneumatic cylinder may be used.

On the other hand, at least one first arm cylinder 50 may be placed under the bottom of the boom 10. As shown in FIG. 16, when a plurality of first arm cylinders 50 are used, the driving force required to drive the first arm 20 increases, so that the working time can be shortened and the working efficiency can be increased.

Hereinafter, the operation of the excavator 2 to which the excavation assembly 1 for use in the excavator according to the embodiments of the present disclosure is to be mounted will be briefly described.

First, during excavation, the boom cylinder 40 is coupled to the upper revolving structure 200 at one end of the cylinder 40 and is coupled to the boom 10 at the other end of the cylinder 40. Thus, when the boom cylinder 40 expands, the boom 10 may be pivoted clockwise. When the boom cylinder 40 shrinks, the boom 10 may be turned counterclockwise.

Further, the first arm cylinder 50 has its one end coupled to the boom 10 and the other end coupled to the first arm 20. Thus, when the first arm cylinder 50 expands, the first arm 20 may be pivoted clockwise. Conversely, when the first arm cylinder 50 shrinks, the first arm 20 may be pivoted counterclockwise.

Moreover, the second arm cylinder 60 has one end coupled to the first arm 20 and the other end coupled to the second arm 30. Thus, when the second arm cylinder 60 expands, the excavation assembly (FIG. 3, FIG. 10, FIG. 12) coupled to the second arm 30 may be pivoted counterclockwise. Conversely, when the second arm cylinder 60 contracts, the excavation assembly (FIG. 3, FIG. 10, FIG. 12) coupled to the second arm 30 may be pivoted clockwise. As such, the first arm cylinder 50 is located beneath the bottom of the boom 10, enabling smooth operation even in confined spaces such as tunnels.

While the present disclosure has been particularly shown and described with reference to exemplary embodiments thereof, and using specific terms, it is to be understood that the embodiments and terms are merely used in a general sense to easily describe the technical contents of the present disclosure and to facilitate understanding of the disclosure and, thus, the disclosure is not limited to the disclosed exemplary embodiments. Those embodiments and terms are not intended to limit the scope of the disclosure. It will be apparent to those skilled in the art that other modifications based on the technical idea of the present disclosure are possible in addition to the embodiments disclosed herein.

INDUSTRIAL AVAILABILITY

The present disclosure relates to an excavation assembly for use in the excavator, and more particularly, to an excavation assembly for use in the excavator whereby, in an excavation work using the excavator, it is possible to increase the ease of moving to various work places and work efficiency thereof, and to smoothly perform the excavation work even in a narrow working space such as a tunnel.

What is claimed is:

1. An excavation assembly for use in an excavator comprising:

a body removably coupled at one end thereof to a pair of spaced shaft-receiving portions formed in a distal end of an arm of the excavator;

a driving mechanism installed inside or on one side of the body and configured to generate at least one of a linear driving force, a rotational driving force, and a striking force;

an excavation tool coupled to the driving mechanism and configured to be driven by at least one of the linear driving force, the rotational driving force, and the striking force transmitted from the driving mechanism, thereby to perform an excavating operation, wherein a direction of the excavation operation by the excavation tool varies depending on coupling positions between the pair of spaced shaft-receiving portions and the body, wherein the body comprises:

a housing having a receiving space defined therein;

a pair of lateral and spaced brackets arranged on opposite sides of the housing on an outer face of the housing respectively; and at least three shaft-type connectors coupled to and extended between the pair of lateral brackets at an upper portion of the housing, wherein the at least three shaft-type connectors are spaced apart from each other with a spacing corresponding to a distance between the pair of spaced shaft-receiving portions, wherein two neighboring shaft-type connectors are selected among the at least three shaft-type connectors and are coupled to the pair of spaced shaft-receiving portions respectively such that a direction of the excavating operation of the excavation tool is determined.

2. The assembly of claim 1, wherein the driving mechanism comprises:

a driver cylinder received within the receiving space and configured to generate a striking force, wherein the driver cylinder has an output shaft;

a drive shaft having one end connected to the output shaft of the driver cylinder, wherein the drive shaft is configured to reciprocate using the striking force received from the driver cylinder; and a connector member having one end coupled to the other end of the drive shaft and the other end removably coupled to the excavation tool, wherein the connector member is configured to receive the striking force from the drive shaft to allow the excavation tool to reciprocally move.

3. The assembly of claim 2, wherein the housing comprises:

a base body hollowed along a reciprocating direction of the drive shaft, wherein the pair of lateral brackets are arranged on opposite sides of the base body on an outer face thereof respectively;

a hollow connection body coupled to the base body at a lower end thereof to define the receiving space together with the base body; and a body cover configured to close an open top portion of the base body with the driver cylinder being received in the receiving space.

4. The assembly of claim 2, wherein the driver cylinder is embodied as a hydraulic cylinder driven by oil supplied from the excavator.

5. The assembly of claim 2, wherein the excavation tool comprises:

a striking tool body detachably coupled to one end of the driver cylinder through the other end of the housing, wherein the tool body is configured to reciprocate using the striking force; and a plurality of boring bits radially formed on a surface of the striking tool body abutting the ground or rock.

6. The assembly of claim 1, wherein the driving mechanism comprises:

a drive motor received inside the receiving space, wherein the motor is configured to generate a rotational drive force;

a drive shaft connected, at one end thereof, to a rotation shaft of the drive motor, wherein the drive shaft is configured to receive the rotational drive force from the drive motor; and a connector member having one end coupled to the other end of the drive shaft and the other end detachably coupled to the excavation tool, wherein the connector member is configured to receive the rotational driving force from the drive shaft to enable a rotation of the excavation tool.

7. The assembly of claim 6, wherein the housing comprises:

a base body hollowed along an extension direction of the rotation shaft of the drive motor, wherein the pair of lateral brackets are arranged on opposite sides of the base body on an outer face thereof respectively;

a hollow connection body coupled to the base body at a lower end thereof to define the receiving space together with the base body; and a body cover configured to close an open top portion of the base body with the drive motor being received in the receiving space.

8. The assembly of claim 6, wherein the drive motor is embodied as a hydraulic motor driven by oil supplied from the excavator.

9. The assembly of claim 6, wherein the excavation tool comprises:

a rotatable body detachably coupled to one end of the drive motor through the other end of the housing, wherein the rotatable body is configured to rotate using the rotational drive force from the drive motor; and a plurality of rotation portions, each portion having one end rotatably coupled to a lower end of the rotatable body, each portion having a plurality of boring bits radially formed on a surface of the portion body abutting the ground or rock.

10. An excavator comprising the assembly of claim 1, the excavator comprising:

a traveling system;

an upper revolving structure on the traveling system;

a boom having one end pivotally coupled to the upper revolving structure;

a first arm having one end pivotally coupled to an opposite end of the boom;

a second arm having one end pivotally coupled to an opposite end of the first arm and the opposite end having the pair of spaced shaft-receiving portions defined therein;

at least one boom cylinder connecting the upper revolving structure and the boom, wherein the at least one boom cylinder is configured to articulate the boom;

at least one first arm cylinder connecting the first arm and the boom, wherein the at least one first arm cylinder is configured to articulate the first arm; and at least one second arm cylinder connecting the first and second arms, wherein the at least one second arm cylinder is configured to articulate the second arm, wherein the at least one first arm cylinder is disposed below a bottom of the boom.

* * * * *